US010226804B2

(12) United States Patent
Ernst de la Graete

(10) Patent No.: US 10,226,804 B2
(45) Date of Patent: Mar. 12, 2019

(54) CASSETTE FOR A ROLLING MILL AND ROLLING MILL EQUIPPED WITH SUCH A CASSETTE

(71) Applicant: FIVES DMS, Noyelles-les-Seclin (FR)

(72) Inventor: Conrad Ernst de la Graete, Seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 403 days.

(21) Appl. No.: 15/021,739

(22) PCT Filed: Sep. 5, 2014

(86) PCT No.: PCT/FR2014/052190

§ 371 (c)(1),
(2) Date: Mar. 14, 2016

(87) PCT Pub. No.: WO2015/036678

PCT Pub. Date: Mar. 19, 2015

(65) Prior Publication Data

US 2016/0221056 A1 Aug. 4, 2016

(30) Foreign Application Priority Data

Sep. 12, 2013 (FR) ..... 13 58791

(51) Int. Cl.
*B21B 13/02* (2006.01)
*B21B 31/10* (2006.01)
(Continued)

(52) U.S. Cl.
CPC ..... *B21B 31/10* (2013.01); *B21B 13/02* (2013.01); *B21B 13/145* (2013.01); *B21B 1/32* (2013.01);
(Continued)

(58) Field of Classification Search
CPC . B21B 13/02; B21B 2013/028; B21B 13/145; B21B 31/08; B21B 31/10; B21B 31/14; B21B 2203/06; B21B 2203/28
See application file for complete search history.

(56) References Cited

U.S. PATENT DOCUMENTS 4,531,394 A 7/1985 Turley et al.
4,763,505 A * 8/1988 Klute ..... B21B 13/145 72/238
(Continued)

FOREIGN PATENT DOCUMENTS

DE 10 2009 060 640 A1 1/2011
EP 2612716 A1 7/2013

OTHER PUBLICATIONS

International Search Report, dated Nov. 3, 2014, from corresponding PCT Application.

*Primary Examiner* — Edward Tolan
(74) *Attorney, Agent, or Firm* — Young & Thompson

(57) ABSTRACT

A cassette intended to be provided on a rolling mill, the cassette (1) forming a self-supporting unit including: a roller intended to constitute one of the two intermediate rollers of the rolling mill; two chocks (3) whereon are mounted the ends of the roller (2); at least one support arm (4) of the at least one side bearing member the support arm extending between the two chocks and being mounted pivotingly in relation thereto. The cassette includes at least one pair of support elements (5) receiving the ends of a rotating shaft (6) of the at least one support arm and the two support elements being detachably fastened, respectively, on the two chocks so as to allow the disassembly of the at least one support arm of the chocks and/or the assembly of the at least one support arm on the chocks independently of the disassembly/assembly of the roller.

13 Claims, 7 Drawing Sheets

(51) Int. Cl.
*B21B 13/14* (2006.01)
*B21B 1/32* (2006.01)

(52) U.S. Cl.
CPC ..... *B21B 2013/028* (2013.01); *B21B 2203/06* (2013.01)

(56) References Cited

U.S. PATENT DOCUMENTS

| | | | | |
|---|---|---|---|---|
| 6,041,636 | A | 3/2000 | Datzuk et al. | |
| 7,481,089 | B2 * | 1/2009 | Valence | B21B 1/28 72/234 |
| 8,966,951 | B2 * | 3/2015 | Cronier | B21B 27/10 72/201 |
| 8,991,231 | B2 * | 3/2015 | Charre | B21B 13/145 72/240 |
| 2012/0151982 | A1 | 6/2012 | Schunn et al. | |
| 2012/0324973 | A1 | 12/2012 | Charre et al. | |

* cited by examiner

FIG. 2 (E.T. / INV.)

FIG. 3 (E.T. / INV.)

CASSETTE FOR A ROLLING MILL AND ROLLING MILL EQUIPPED WITH SUCH A CASSETTE

FIELD OF THE INVENTION

The invention relates to a cassette for a rolling mill, as well as a rolling mill provided with such a cassette.

The field of the invention is that of laterally supported Sexto rolling mill stands, and in particular rolling mills known under the name "Z High".

BACKGROUND OF THE INVENTION

These rolling mills have their application, in line, for example, in annealing and pickling lines or, off line, such as reversible rolling mills, for metal strip.

A Quarto rolling mill stand comprises a retaining stand wherein are provided four parallel axis rollers, namely respectively two upper and lower working rollers, defining the gap of the passage of the strip to be rolled, as well as two upper and lower bearing rollers, bearing respectively on the working rollers on the side opposite that of the gap of the passage.

A Sexto rolling mill comprises two additional rollers in relation to a Quarto, namely two intermediate rollers interposed respectively between each working roller and the corresponding bearing roller.

In such rolling mills, each bearing roller and each intermediate roller, are mounted rotatingly at their ends on chocks, by the intermediary of bearings, for example with rollers or hydrostatic bearings. These chocks are supports which can be displaced according to a direction parallel to the clamping plane, between the posts of the stand.

Conventionally, balancing cylinders allow for the displacement of the chocks of the intermediate rollers. These balancing cylinders make it possible to change the relative position of the chocks and of their roller, which makes it possible among other things, to open the stand in order to facilitate the engagement of the product to be rolled, or to displace these elements in order to facilitate the disassembling of the rollers. These balancing cylinders can also make it possible to camber the intermediate rollers.

An advantage of a Sexto rolling mill stand is the possibility of using, in comparison with a Quarto stand, working rollers of smaller diameter, which makes it possible to obtain a reduction in the thickness greater than the product to be rolled, for the same rolling force.

A Sexto rolling mill moreover offers the possibility to axially offset the two intermediate rollers, and for the purpose of applying the rolling force solely on the width of the strip to be rolled, not over the entire length of the working rollers.

In a Sexto rolling mill referred to as "laterally supported", often, the working rollers are not mounted on chocks, but on the contrary are provided floating. It is then necessary to maintain their axial position, by the intermediary of axial abutments, but also to maintain their lateral position by means of side bearing members, such as side bearing rollers or tracks.

It is as such known from document U.S. Pat. No. 4,531,394 a rolling mill design of the laterally supported Sexto type. Such a rolling mill comprises a retaining stand comprising two pairs of posts separated from each other at the two ends of the stand, at least two posts of the same pair defining an access window. Such a rolling mill comprises two working rollers, two bearing rollers and two intermediate rollers, inserted respectively between one of the working rollers and the corresponding bearing roller.

In this rolling mill, the bearing rollers and the intermediate rollers are mounted rotatingly at their ends on chocks, whereas the working rollers are provided floating. Each working roller is laterally supported, on each side of the working roller, by a side bearing roller, itself bearing on two series of tracks (guiding rollers) arranged over the length of the roller.

In this rolling mill design, for each working roller, the corresponding two side bearing rollers are integral with the two chocks of said intermediate roller. Each side bearing roller, as well as its bearing tracks are mounted on a support arm that extends between the two chocks of the intermediate roller, with each arm being mounted pivoting around a rotating shaft of which the ends are threaded into bores of the chocks and fixed to the latter.

The intermediate roller, chocks of the intermediate roller, support arms (right and left) unit, form a self-supporting unit, commonly referred to as a "cassette" or "insert" which can be introduced into the stand, or removed from the stand through the access window, during maintenance, by sliding the unit according to the direction of the rollers.

In such a rolling mill, four load distributing beams extend respectively between the posts of the stand, respectively on support arms of the upper cassette and of the lower cassette. Each load distributing beam supports a beam, referred to as preloading, mobile in translation in relation to the corresponding load distributing beam, which can be displaced towards the inside of the stand according to a substantially horizontal direction. Pushing cylinders make it possible to constrain the mobile beam in contact with the support arm pivoting to preload the side bearing roller on the working roller.

It is also known from document U.S. Pat. No. 6,041,636 an alternative design for a rolling mill of the laterally supported Sexto type, with "insert" or "cassette". As in the preceding document, the intermediate roller, chocks of the intermediate roller, support arms (right and left), side bearing rollers and tracks, right and left, unit, form a self-supporting unit which can be introduced into the stand or removed through the access window of the stand during maintenance, by sliding the unit according to the direction of the rollers.

In this document U.S. Pat. No. 6,041,636, the chocks of the intermediate rollers are mounted on camber blocks. The cylinders of the camber blocks make it possible, during operation, to bring the intermediate rollers closer together, in a working position shown in FIG. 5 of this document, or to separate the intermediate rollers to a position, shown in FIG. 4, allowing the inserts to be removed by sliding.

In this document, it is known to supply with lubricant the rollers of the tracks of the support arms of the insert, using a source of lubricant. Connection/disconnection devices make it possible, in the working position of the rollers, to connect the source of lubricant to lubrication bores provided in the shocks, and to automatically disconnect the bores when the intermediate rollers and their chocks are vertically separated by the camber blocks.

No additional operation to connect/disconnect the source of lubricant is required during maintenance, in particular when the inserts must be removed or introduced into the stand. To this effect, each connection device comprises an element, marked 57 named "plunger", hollow, intended to conduct the lubricant, and which makes it possible, in the working position of the intermediate rollers, such as shown in FIG. 9, to attach in a relatively sealed manner the hole of the chock by the intermediary of a seal. This element is mobile, vertically in translation, constrained towards its sealed position by means of a spring, marked 58. In the connection position, the lubricant flows from the source of lubricant through the mobile element and to the hole of the chock. The lubricant then flows from the bore of the chock, and to the rollers of the bearing tracks mounted on the support arm by the intermediary of the shaft, marked 17 which is hollow and whereon the support arm is mounted pivotingly.

When the intermediate rollers are separated to their position of withdrawal by the camber blocks, the course of travel of the mobile element is limited, less than the course of travel of the displacement of the camber blocks, as such making it possible to guarantee an inter-space between the mobile element and the chock, such as shown in FIG. 8. It is then possible to remove the insert, without friction between the chocks and the mobile element.

In the insert (or cassette) of document U.S. Pat. No. 4,531,394 or of document U.S. Pat. No. 6,041,636, the ends of the shafts marked 17 of the support arms are inserted into bores made in the mass of the body of each chock. These bores also serve as ducts for the lubricant supplying these shafts which are hollow. Furthermore the ends of the intermediate roller are mounted rotatingly on the chocks by the intermediary of bearings received in other bores of the chocks.

When the cassette is mounted, these ends of the shafts of the support arms and of the intermediate roller must be introduced simultaneously into the corresponding bores of the chocks. Likewise, and according to the observations of the inventor, disassembling the cassette requires separating the two chocks by a distance greater than their nominal spacing for mounting, requiring that the intermediate roller and the two support arms be removed simultaneously.

In practice, these operations are delicate and require specific tools comprising a stand making it possible to turn over the lower cassette. Due to the simultaneous exiting of the support arms and of the intermediate roller during the disassembling operations, another specific stand is used in order to provide support for the support arms, the intermediate roller and the chocks during these disassembly/mounting operations.

SUMMARY OF THE INVENTION

The purpose of this invention is to overcome the aforementioned disadvantages by proposing a cassette for a laterally supported Sexto rolling mill, with simplified disassembly and mounting, that does not require any complex stand for these maintenance operations.

Another purpose of this invention is, at least according to an embodiment, to propose a cassette for which the lubrication circuit has an improved seal in relation to circuits of prior art that use the hollow rotating shaft of the support arms as a duct for fluids.

Other purposes and advantages shall appear in the following description which is provided solely for the purposes of information and which does not have for purpose to limit it.

As such the invention relates first of all to a cassette intended to be provided on a rolling mill, said rolling mill comprising a retaining stand comprising two pairs of posts separated from one another at the two ends of the stand, at least two posts of the same pair defining an access window allowing said cassette to be withdrawn from or introduced into said retaining stand, said rolling mill comprising two lower and upper working rollers, two lower and upper intermediate rollers, and two lower and upper bearing rollers, as well as at least one side bearing member for each working roller, and wherein said cassette forms a self-supporting unit that comprises:

- a roller intended to constitute one of the two intermediate rollers of said rolling mill,
- two chocks whereon are mounted the ends of said roller,
- at least one support arm of said at least one side bearing member, able to laterally support one of the working rollers of the rolling mill, said support arm extending between the two chocks and being mounted pivotingly in relation to said chocks.

According to the invention, said cassette comprises at least one pair of support elements receiving the ends of a rotating shaft of said at least one support arm and in that the two support elements are detachably fixed, respectively, on the two chocks and in such a way as to allow for the disassembling of said one support arm of the chocks and/or the mounting of said at least one support arm on said chocks, without modifying the spacing between said chocks, and independently of the disassembling/mounting of said roller.

According to characteristics of the invention, taken individually or in combination:

- each chock has, seen from above, a U shape, with a median portion receiving one of the ends of said roller, and two side portions for the support of two support arms;
- one at least of the side portions of the chock is of a dimension less than said median portion, in such a way as to create with the median portion a housing for the receiving and the fastening of said support element;
- said support elements are detachably fixed on the chocks by means of screws;
- said support element and said chock have a mechanical foolproof device in order to provide for the proper positioning of said support element on said chock;
- the mechanical foolproof device comprises a complementary pin/hole pair, with the pin/hole pair belonging respectively to said chock and to said support element, or inversely, with the pin and the hole being mutually engaging in order to provide for the proper positioning of said support element on said chock;
- each support element can be displaced on the rotating shaft, axially, according to a limited course of travel;
- said rotating shaft is mounted fixed in relation to the chocks and wherein said support arm is mounted pivoting in relation to said rotating shaft, or alternatively,
- said rotating shaft is mounted pivotingly in relation to the chocks and the support arm is mounted fixed in relation to said rotating shaft;
- the cassette comprises two support arms, each supporting a side bearing member and wherein each of the support arms is detachably fastened to the chocks by the intermediary of a pair of support elements;
- the cassette has spring means and abutments constraining said at least one support arm, or the two support arms into a position separated toward the exterior;
- at least one of the support elements has an internal duct intended to convey a lubricant to on-board members of the support arm, or to the other support element, and which extends an internal duct of the corps of one of the chocks;

The invention also relates to a rolling mill comprising two upper and lower working rollers, two upper and lower intermediate rollers, and two upper and lower bearing rollers, as well as at least one side bearing member for each working roller, said rolling mill comprising a retaining stand comprising two pairs of posts separated between them at the two ends of the stand, at least two posts of the same pair defining an access window allowing an upper cassette to be removed from or introduced into said retaining stand in accordance with the invention, comprising said intermediate upper roller, and said at least one side bearing member of said upper working roller, and allowing for the removal or introduction of a lower cassette in accordance with the invention comprising said lower intermediate roller, and said at least one side bearing member of said lower working roller.

BRIEF DESCRIPTION OF THE DRAWINGS

The invention shall be better understood when reading the following description along with the drawings in the annex among which.

DETAILED DESCRIPTION OF THE INVENTION

Figure 1:
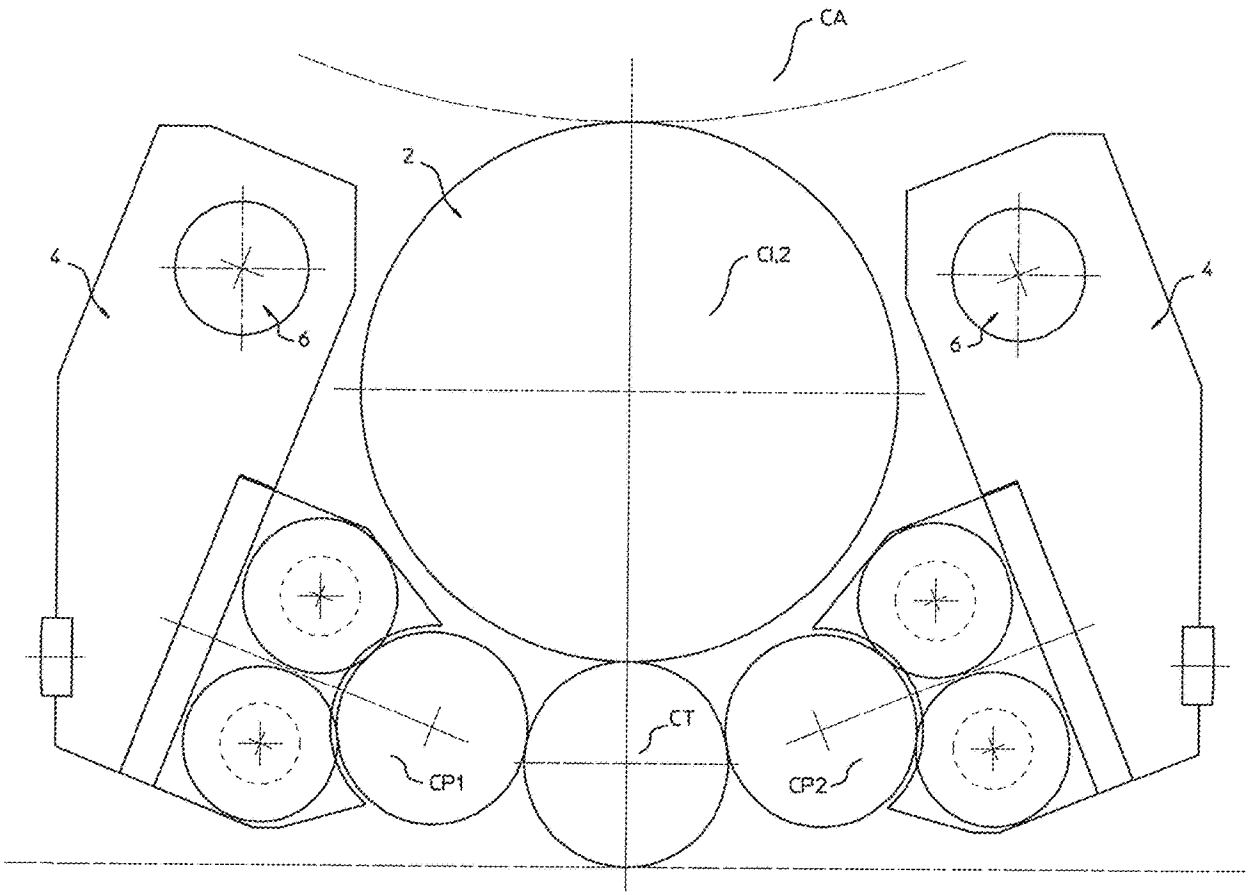
FIG. 1 is a partial view of the upper portion of a rolling mill, and more particularly showing the upper working roller WR, the upper intermediate roller and the upper bearing roller, as well as side bearing members for the working roller, on either side of the clamping plane.

As such the invention first relates to a cassette 1 intended to be provided on a rolling mill of the laterally supported Sexto type.

Such a rolling mill has:

- a retaining stand comprises two pairs of posts 12 separated from each other at the two ends of the stand, at least two posts of the same pair defining an access window allowing said cassette to be removed from or introduced into said retaining stand,
- two lower and upper working rollers CT, two lower and upper intermediate rollers CI, and two bearing rollers CA, as well as at least one side bearing member CP1, CP2 for each working roller CT.

The two lower and upper working rollers CT, define the gap of the strip to be rolled and are provided floating in the retaining stand. They are maintained axially by axial abutments and laterally by the side bearing members CP1, CP2. The side bearing members are more preferably in the number of two per working roller CT, in order to maintain said working roller CT, on each side of the clamping plane.

The side bearing members can comprise a first side bearing roller CP1 and a second side bearing roller CP2, arranged on either side of the working roller CT.

The cassette 1 forms a self-supporting unit comprising:

- a roller 2 intended to constitute one of the two intermediate rollers CI of said rolling mill,
- two chocks 3 whereon are mounted rotatingly the ends of said roller 2 by the intermediary of a bearing,
- at least one support arm 4 of said at least one side bearing member, able to laterally support one of the working rollers CT of the rolling mill, said support arm 4 extending between the two chocks 3 and being mounted pivotingly in relation to said chocks 3.

Preferably, said cassette comprises two support arms 4, on either side of said roller 2, and respectively supporting two side bearing members, in particular two side bearing rollers CP1, CP2.

Each side bearing roller CP1 or CP2 can bear against two series of tracks. The tracks are mounted on two axes by the intermediary of rollers at the lower portion of the support arm 4.

Such a cassette can constitute the upper cassette and/or the lower cassette of a rolling mill of the laterally supported Sexto type.

Such a rolling mill conventionally has, in addition to said retaining stand and said bearing, intermediate and working rollers:

- means for applying clamping forces between the chocks of the bearing rollers CA,
- means for applying vertical forces of cambering on the intermediate rollers CI,
- means for applying a preloading force on the side bearing members CP1, CP2.

The means for applying vertical cambering forces on the intermediate rollers, include, conventionally, for each intermediate roller CI, a set of balancing cylinders acting on the pushing on the side lugs 35 of the chocks 3 of the cassette 1. The cylinders can be single-acting cylinders, distributed above and below each lug 35 and acting solely on the pushing to camber the intermediate roller as positive or as negative. Alternatively camber blocks can be provided mobile vertically in relation to the posts in order to ensure this same function, by cooperating with said lugs 35.

The means for applying a preloading force can include, for each side bearing member CP1, CP2, conventionally, at least one preloading cylinder 10 acting on the pushing on one of the support arms 4 to constrain the side bearing member CP1 or CP2 on the working roller CT. Conventionally these means are provided on a corresponding load distributing beam 11. This beam 11 extends between two corresponding posts 12 at the two ends of the stand. The position of this load distributing beam 11 can be adjusted, horizontally, in order to come close to the support arm 4, or on the contrary to move away from said support arm 4 for example by means of a screw/nut actuator 13.

According to the invention, said cassette 1 comprises at least one pair of support elements 5 receiving the ends of a rotating shaft 6 of said at least one support arm 4. Advantageously, the two support elements 5 are detachably fixed, respectively, on the two chocks 3 of the cassette and in such a way as to allow for the disassembly of said at least one support arm 4 of the chocks 3 and/or the mounting of said at least one support arm 4 on said chocks 3, without modifying the spacing between said chocks 3, and independently of the disassembling/mounting of said roller 2.

Figure 2:
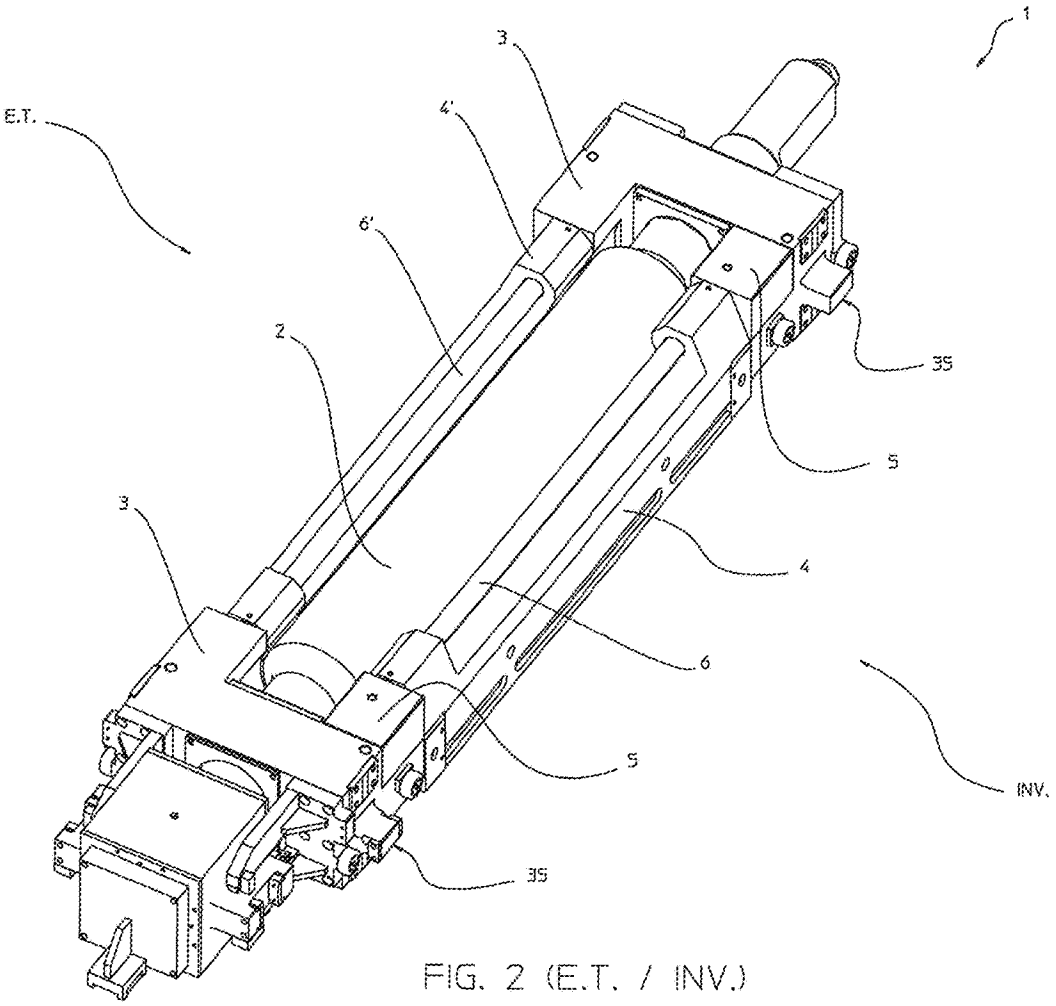
FIG. 2 is a view of a "hybrid" cassette having, on the left side, a mechanical connection of the support arm with the chocks such as known in prior art and, on the right side, the mechanical connection of the support arm with the chocks in accordance with the invention.

FIG. 2 shows, for the proper understanding of the invention a cassette comprising on the right, a support arm 4 fixed to the chocks in accordance with the invention by the intermediary of a pair of support elements 5, and on the left, a support arm 4 fixed to the chocks according to prior art, thanks to a rotating shaft of which the ends are threaded directly into the holes of the bodies of the two chocks.

Figure 3:
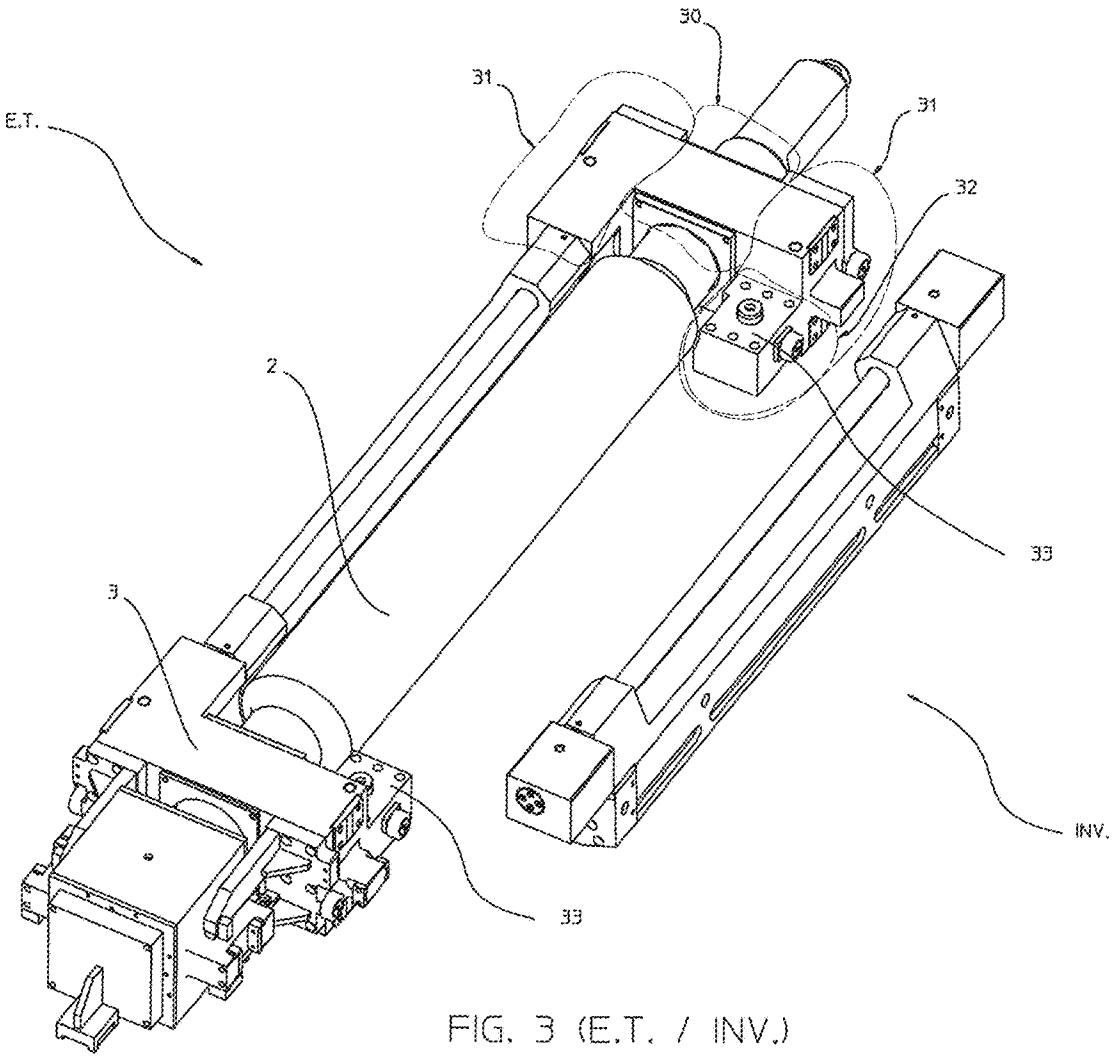
FIG. 3 is a view of the cassette such as shown in FIG. 2, showing the disassembling of the support arm (right side) of the chocks, according to the invention, without separating the chocks and without removing the roller, with this disassembly not being possible for the support arm on the left side.
Figure 4:
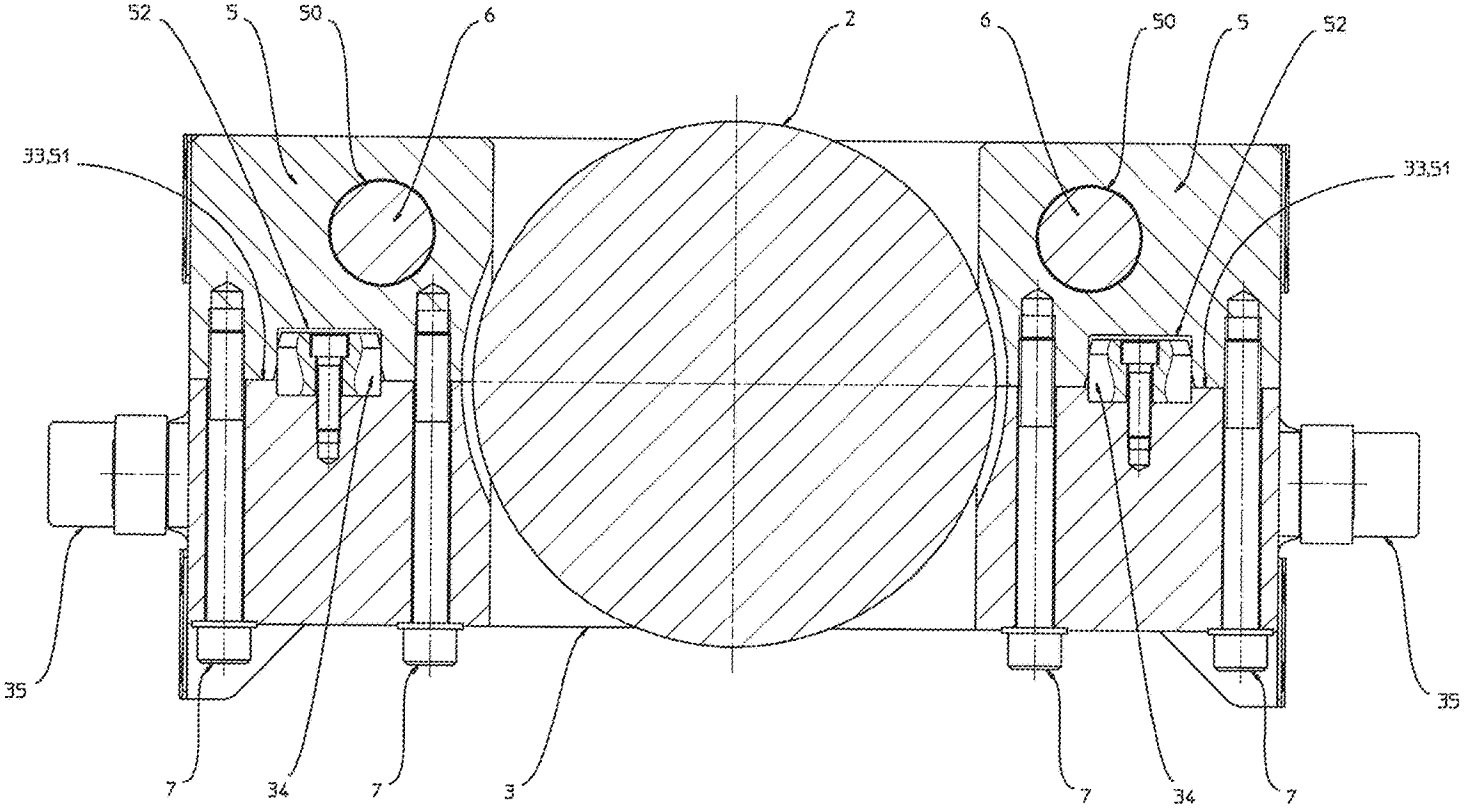
FIG. 4 is a cross-section view according to a plane perpendicular to the roller of a cassette in accordance with the invention.

Such as shown in FIG. 3, note that, according to the invention, the support elements 5, removable, allow for the disassembling and the removal of the support arm 4, right, without having to modify the spacing of the chocks 4, and as such, without having to disassemble the roller 2.

Then, the support elements 5 allow for the mounting of the support arm 4, although the ends of the roller 2 are already received in the bearings of the chocks 3. The invention as such allows for the assembling/mounting of the support arm 4, independently of the assembling/mounting of the roller 2.

On the contrary, the support arm 4', left, according to prior art, requires separating the chocks in order to extract the ends of the rotating shaft 6' from the bores of the chocks, as such requiring a simultaneous disassembling of the roller 2. The mounting of the support arm 4' on the chocks also requires mounting the roller 2 on the chocks.

Figure 5:
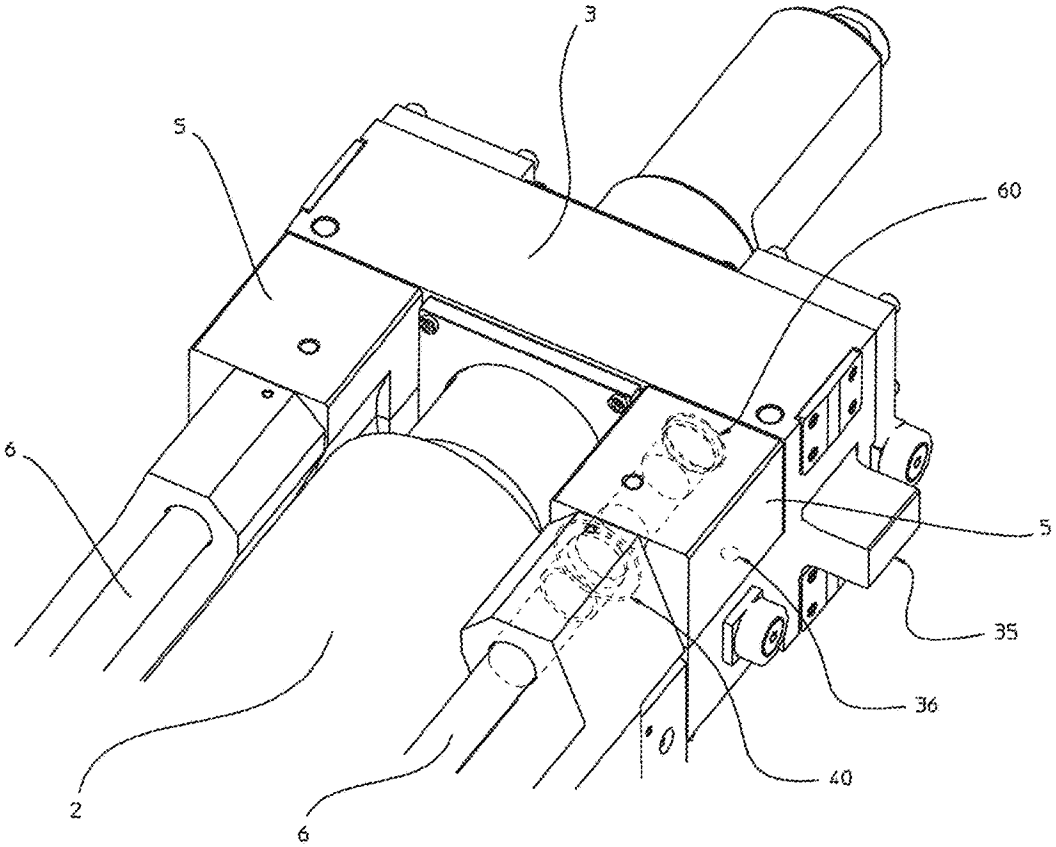
FIG. 5 is a partial transparent view of the cassette such as described in FIG. 4.
Figure 6:
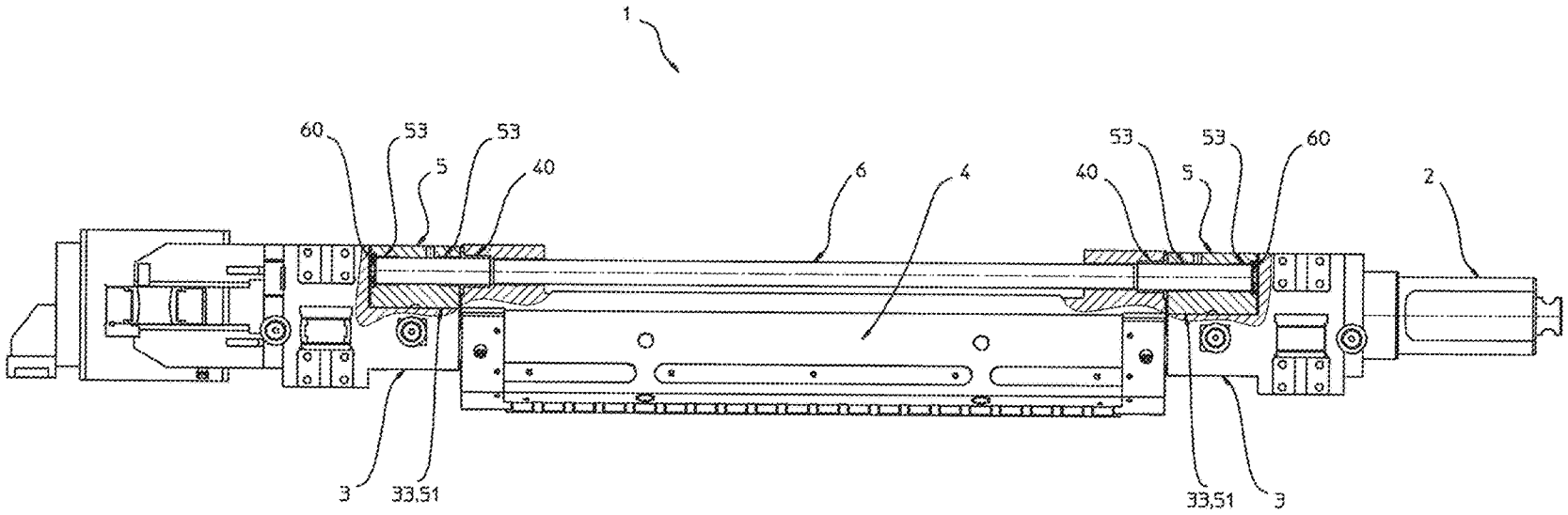
FIG. 6 is a view according to a section, substantially vertical, passing through the axis of the support arm.
Figure 7:
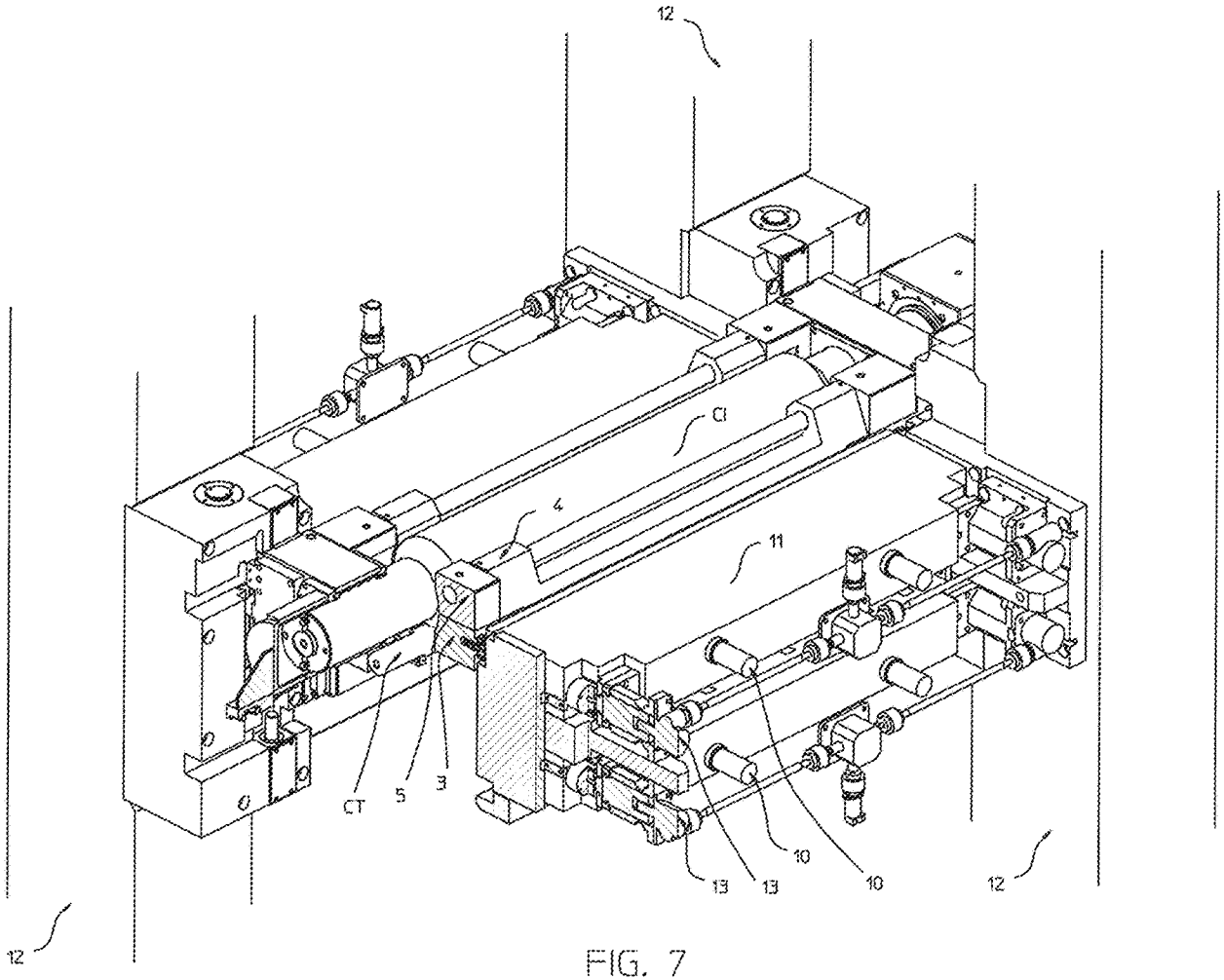
FIG. 7 is a perspective view of the upper cassette, in accordance with the invention, in position in the retaining stand of the rolling mill.

Such as shown by way of an non-restricted example in FIG. 5, each chock 3 can have, seen from above, a U shape, with a median portion 30 receiving one of the ends of said roller 2 by the intermediary of a bearing (i.e. a hydrostatic bearing or a roller), and two side portions 31 for the respective support of two support arms 4.

The one at least, and even more preferably the two side portions 31 of the chock 3 are each of a dimension less (according to the height) than said median portion 30, in such a way as to create with the or each median portion 30 a housing 32 for the receiving and the fastening of said support element 5. The housing is created, in particular by the bearing surface which is defined in what follows.

The support element 5 is a body that has a bore 50, in particular of the through type, intended to receive one of the ends of the rotating shaft 6, to the nearest nesting play, possibly by the intermediary of two slide rings 53. The body of this support element 5 can have a bearing surface 51, intended to bear on a bearing surface 33 of said side portion 31 of the chock. According to an embodiment, this bearing surface 33 is oriented substantially parallel to the axis of the roller 2, and can be horizontal.

Possibly, in order to provide for the proper positioning of the support element 5 on the chock 3, said support element 5 and said chock 3 have a mechanical foolproof device 34, 52.

This mechanical foolproof device 34, 52, can comprise, as a non-restricted embodiment, a complementary pin 34/hole 52 pair belonging respectively to said chock 3 and to said support element 5, or inversely and oriented according to the direction perpendicular to the bearing surface 33. The pin 34 engages in the hole 52, to the nearest nesting play, in order to provide the proper positioning of said support element 5 on said chock 3, at least according to the two directions of the space contained in a plane parallel to the bearing surface.

The support element 5 can have threaded bores, facing the bores of the body of the chock 3, allowing for the insertion of screws 7 and the tightening by screwing of the support element 5 onto the bearing surface 33 of the chock 3.

According to an embodiment, said rotating shaft 6 is mounted fixed in relation to the chocks 3. Each end of the rotating shaft 6 can be inserted into a bore made in the mass of the body of the support element 5. A washer 60, or another equivalent blocking element can make it possible to limit to a short course of travel, for example between 2 mm and 8 mm, (i.e. + or −2 mm) the axial displacement of the rotating shaft 6 in the support element 5. In order to facilitate these small axial displacements, said slide rings 53, for example made of bronze can be provided between the rotating shaft 6 and the body of the support element 5.

Such axial displacements allow for a slight adjustment in the spacing between the two support elements 5 in relation to the actual dimensions between the chocks 3, and as such facilitate the mounting of the support arm to the chocks, in particular when the engaging portions (i.e. pin 34, hole 52) of the mechanical foolproof device must be nested.

The rotation of the support arm 6 in relation to the chocks 3 can be obtained by the pivoting of said support arm 4 in relation to the rotating shaft 6. To this effect, the support arm 4 can be provided with slide rings 40, for example made of bronze, between the body of the support arm 44 and the rotating shaft 6. Alternatively the rotation of the support arm in relation to the chocks can be obtained, according to an example not shown, by the rotation of the rotating shaft in relation to the chocks.

Possibly, the body of at least one of the support elements 5 can have an internal duct (not shown) for a lubricant fluid, which in particular extends an internal duct on one of the chocks 3, with the duct opening onto an opening 36 on the second bearing surface 33. This fluid circuit can be used to conduct a lubricant and then convey it by means of one or several hoses or pipes in the support arm 4, for example to lubricate guiding members such as track rollers bearing against the side bearing roller CP1 or CP2, or to the other support element 5 in order to lubricate the rollers of the other chock.

According to the observations of the inventor, such a circuit, independent of the rotating shaft 6, is more reliable and has a better seal than that known in prior art and which uses the hollow shaft, marked 17. According to the observations of the inventor such a circuit such as disclosed by document U.S. Pat. No. 6,041,636, has wear and tear, and is subject to leaks at the articulations of the hollow shaft.

Advantageously, the disassembling of said at least one support arm 4 of the chocks 3 and/or the assembling of said at least one support arm 4 on said chocks 3 does not require any intervention on the pipes or the hoses of this fluid circuit, as the latter are onboard the non-dissociated unit comprising the support arm 4, the rotating shaft 6 and the two support elements 5.

According to an advantageous embodiment, said cassette 1 can have spring means and abutments that maintain said at least one support arm 4, or the two support arms 4 in a position spaced outwards. These spring means, in particular in the form of a torsion or pressure spring, can be provided between the support arm 4 and the chocks 3, or between the support arm 4 and the support element 5, in order to constrain the support arm, and as such the side bearing member CP1 or CP2 that it carries at a distance from the working roller CT, when the cassette is in the stand.

The support arms 4 retract as such against the abutments, when they are not constrained by the preloading cylinders, at a distance from the working roller CT, in a position that facilitates the removal of the working roller from the stand.

Naturally other embodiments of the invention could have been considered without however leaving the scope of the invention such as defined by the claims hereinafter.

NOMENCLATURE

1. Cassette,
2. Roller,

3. Chocks,
4. Support arm (fixed to the chocks according to the invention),
4'. Support arm (fixed to the chocks according to prior art),
5. Support elements,
6. Rotating shaft (Support arm 4 according to the invention),
6'. Rotating shaft (Support arm 4' according to prior art),
7. Screw,
10. Preloading cylinder,
11. Load distributing beam,
12. Stand posts,
13. Screw/nut actuator,
30. Median portion (Chock 3),
31. Side portions (Chock 3),
32. Housing (Chock 3),
33. Bearing surface (Chock 3),
34. Centring pin (Chock 3),
35. Lugs (Chock 3),
36. Opening (Chock),
40. Slide ring,
50. Bore (Support element 5),
51. Bearing surface (Support element 5),
52. Centring hole (Support element 5),
53. Slide ring (Support element 5).
60. Lock washer (Rotating shaft),
CA. Bearing roller,
CI. Intermediate roller,
CT. Working roller,
CP1. Lateral bearing roller,
CP2. Lateral bearing roller.
ET. State of the art,
INV. Invention.

The invention claimed is:

1. A cassette for a rolling mill, said rolling mill comprising:
a retaining stand comprising two pairs of posts spaced from one another at two ends respective of the stand,
at least one of said pairs of posts defining an access window allowing said cassette to be removed from or introduced into said retaining stand,
said rolling mill comprising:
two working rollers,
two intermediate rollers, and
two bearing rollers,
wherein each of said two working rollers comprises at least one side bearing member,
and wherein said cassette forms a self-supporting unit comprising:
a roller comprising two ends that forms one of said two intermediate rollers,
two chocks with a space therebetween, whereon are mounted the ends of said roller,
at least one support arm of said at least one side bearing member, which comprises a rotating shaft and which laterally supports one of the working rollers of the rolling mill, said support arm extending between the two chocks and being mounted pivotingly in relation to said chocks,
said cassette further comprising:
at least one pair of support elements that receives ends of the rotating shaft of said at least one support arm,
wherein the two support elements, of said pair of support elements, are detachably fixed, respectively, on the two chocks and allow for disassembling of said at least one support arm of the chocks and/or assembling of said at least one support arm on said chocks, without modifying a spacing between said chocks, and independently of disassembling or assembling of said roller.

2. The cassette according to claim 1, wherein each of said chocks has a U shape, the U shape comprising:
a median portion of the U shape receiving one end of said roller, and
two side portions that respectively support two support arms.

3. The cassette according to claim 2, wherein at least one of the side portions of the chock is of a dimension less than said median portion, in such a way as to define with the median portion a housing for receiving and fastening said support elements.

4. The cassette according to claim 1, wherein said support elements are detachably fastened on the chocks via a screw.

5. The cassette according to claim 1, wherein said support element and said chock have a mechanical foolproof device that facilitates proper positioning of said support element on said chock.

6. The cassette according to claim 5 wherein the mechanical foolproof device comprises a pin and a hole,
wherein one of the pin and the hole is located on said chock and the other of the pin and the hole is located on said support element, and
wherein the pin and the hole mutually engage to provide for proper positioning of said support element on said chock.

7. The cassette according to claim 1, wherein each support element is configured to be displaced on the rotating shaft, axially, according to a limited course of travel.

8. The cassette according to claim 1,
wherein said rotating shaft is mounted fixed in relation to the chocks and wherein said support arm is mounted pivoting in relation to said rotating shaft.

9. The cassette according to claim 1, comprising two support arms, each supporting a side bearing member and wherein each of the support arms is detachably fastened to the chocks by an intermediary of a pair of support elements.

10. The cassette according to claim 1, further comprising a spring and at least one abutment that maintain said at least one support arm in a position spaced outwards.

11. The cassette according to claim 1, wherein at least one of the support elements has an internal duct that conveys a lubricant to members onboard the support arm or to another support element and which extends an internal duct of the body of one of the chocks.

12. A rolling mill comprising:
two upper and lower working rollers,
two upper and lower intermediate rollers, and
two upper and lower bearing rollers,
wherein each of said two working rollers comprises at least one side bearing member,
said rolling mill further comprising a retaining stand comprising two pairs of posts spaced apart at two respective ends of the stand,
wherein at least one of said pairs of posts defines an access window, said access window allowing for removal from or introduction into said retaining stand of an upper cassette according to claim 1 and of a lower cassette,
wherein said upper cassette comprises:
said upper intermediate roller, and
said at least one side bearing member of said upper working roller, and
wherein said lower cassette comprises:
said lower intermediate roller, and said at least one side bearing member of said lower working roller.

13. The cassette according to claim 1, wherein said rotating shaft is mounted pivotingly in relation to the chocks, and the support arm is mounted fixed in relation to said rotating shaft.

* * * * *